United States Patent [19]

Gelbard et al.

[11] 4,077,229

[45] Mar. 7, 1978

[54] HOUSEHOLD REFRIGERATOR WITH AIR CIRCULATION AND COOLING ARRANGEMENT

[75] Inventors: Robert B. Gelbard; James R. Griffin, both of Louisville, Ky.

[73] Assignee: General Electric Company, Louisville, Ky.

[21] Appl. No.: 756,235

[22] Filed: Jan. 3, 1977

[51] Int. Cl.[2] ..... F25B 5/00; F25D 11/02

[52] U.S. Cl. ..... 62/283; 62/441

[58] Field of Search ..... 62/283, 441

[56] References Cited

U.S. PATENT DOCUMENTS

| | | | |
|---|---|---|---|
| 1,727,946 | 9/1929 | Spreen | 62/283 |
| 1,985,138 | 12/1934 | Banta | 62/283 |
| 1,996,870 | 4/1935 | Kratky | 62/283 |
| 3,050,956 | 8/1962 | Mann et al. | 62/283 |
| 3,111,817 | 11/1963 | Solley, Jr. | 62/283 |
| 3,116,615 | 1/1964 | Harle | 62/283 |
| 3,381,494 | 5/1968 | Steelman | 62/283 |
| 3,393,530 | 7/1968 | Koch | 62/275 |
| 3,455,119 | 7/1969 | Bright | 62/441 |
| 3,834,176 | 9/1974 | Clarke | 62/419 |
| 3,893,307 | 7/1975 | Jacobs | 62/441 |

*Primary Examiner*—Lloyd L. King
*Attorney, Agent, or Firm*—Francis H. Boos

[57] ABSTRACT

A refrigerator including two compartments, one of which is maintained at a temperature above freezing for the storage of fresh foods and the other of which is maintained at a temperature below freezing for storage of frozen foods is cooled by air circulated over an evaporator disposed outside the compartments. The evaporator comprises a metal plate having a cooling element mounted thereon in heat exchange relationship. The evaporator is positioned in the cabinet in such a manner that the cooling element is disposed in a first passage and air is circulated over the cooling element and then in proportioned amounts to the aforementioned compartments. To reduce the amount of frost collecting on the cooling element a second passage is provided in the refrigerator cabinet adjacent the opposite side of the plate from that on which the cooling element is mounted. Moist air returning from the fresh food compartment is caused to circulate through this second passage in contact with the aforementioned plate so that a substantial amount of the moisture in this air deposits on the plate as frost before the air reaches the first passage and the cooling element. The plate is spaced from the rear inner wall of the refrigerator to form the second passage between the plate and the inner wall of the refrigerator. The warm air circulating through the second passage, which is disposed adjacent a substantial portion of the rear inner wall of the refrigerator, reduces heat leakage from the exterior of the refrigerator to the interior of the refrigerator.

13 Claims, 2 Drawing Figures

HOUSEHOLD REFRIGERATOR WITH AIR CIRCULATION AND COOLING ARRANGEMENT

BACKGROUND OF THE INVENTION

1. Field of the Invention

This invention relates to household refrigerators of the type in which an above-freezing and a below-freezing storage compartment are cooled by an evaporator positioned outside the compartments and more particularly with arrangements related to the formation of frost on and removal of frost from the evaporator.

2. Description of the Prior Art

Many present day household refrigerators include a compartment maintained at a below freezing temperature for the storage of frozen foods and a second compartment maintained at an above-freezing temperature for storage of fresh foods. In many such refrigerators, an evaporator for providing cooling for both the frozen food compartment and the fresh food compartment is positioned outside both compartments and air is circulated over the evaporator and then through the compartments to provide for cooling thereof. The evaporator itself is maintained at a temperature substantially below freezing. In order to maintain the greatly differing temperatures required in the two compartments, a substantially greater portion of the air flowing over the evaporator is directed to the frozen compartment than to the fresh food compartment. For example, approximately 90% of the air may be directed to the frozen food compartment.

Much more frequent access is usually required to the fresh food compartment than to the frozen food compartment. Particularly, in warm and humid weather, such frequent door opening causes entry into the fresh food compartment of air having a substantial amount of moisture therein. When this air is circulated over the evaporator, which may be at a temperature of −5° F., for example, the moisture in the air is deposited as frost on the evaporator. This deposition of frost on the evaporator has two adverse effects on the efficient operation of the refrigerating system. First, the frost, by providing an insulating coating over the coils of the evaporator, reduces the heat transfer to the evaporator from the air circulating thereover and thereby decreases the cooling effectiveness of the evaporator and the efficiency of operation of the refrigerator. Secondly, in a refrigerator of the type here under consideration, where the evaporator is positioned in a confined passage and air is circulated over the evaporator and then to the two food storage compartments, the build-up of frost progressively restricts the space for flow of air through the passage and thereby further decreases the effectiveness of the refrigerating system.

A number of arrangements have been proposed in the prior art for reducing the rate of accumulation of frost on the evaporator employed in refrigerators of this type in an effort to reduce or solve the above problems. In several of these arrangements an auxiliary evaporator is provided upstream of the main evaporator so that the moist circulating air first comes in contact with the auxiliary evaporator and deposits thereon, thereby reducing the amount of frost depositing on the main evaporator. In some such arrangements the frost on the auxiliary evaporator may be removed without at the same time defrosting the main evaporator.

In other prior art arrangements a single evaporator is employed but formed in two sections, the first of which has fins spaced relatively widely and the second of which has fins spaced more closely together. In such arrangements, the air returning from the fresh food compartment is first caused to flow over the first section of the evaporator and then over the second section of the evaporator. Since the air first strikes the first section of the evaporator, the frost tends to deposit more heavily thereon and, since the spacing between the fins is greater, the frost has a lesser effect in blocking flow of circulating air over the evaporator.

In still another prior art arrangement, air returning from the fresh food compartment and air returing from the frozen food compartment are caused to flow through two adjacent passages arranged in heat exchange relationship. This causes a reduction in the temperature of the air returning from the fresh food compartment and causes the moisture therein to be deposited in one of the passages before reaching the evaporator, thereby reducing the amount of frost forming on the evaporator. The frost depositing in this passage is later removed by defrosting.

In accordance with the present invention, a construction is provided which reduces the amount of frost forming on the evaporator in a refrigerator of the type here under consideration, and which accomplishes this result in a simpler and more effective manner and with advantages not present in the prior art type of arrangements discussed above.

Accordingly, it is an object of this invention to provide a two-temperature, two-compartment refrigerator including an improved arrangement for air circulation therein.

It is another object of this invention to provide in a refrigerator of this type an improved arrangement for deposition of frost from the circulating air which permits a greater length of time between defrosting operations without adverse effect on the efficiency of the refrigerating system, or alternatively permits defrosting to be accomplished in a shorter time.

It is a further object of this invention to provide in a refrigerator of this type an improved air circulation and frost deposition arrangement which significantly reduces the amount of frost deposited on the evaporator and materially reduces interference with the circulation of air thereover.

It is still a further object of this invention to accomplish the above results with minimal structural changes in existing refrigerator components.

SUMMARY OF THE INVENTION

In carrying out the objects of this invention, in one form thereof, a conventional refrigerator cabinet is employed which includes an outer wall and an inner wall spaced from the outer wall, with the space between the inner walls being filled with suitable thermal insulation. There are formed within the interior of the refrigerator cabinet two compartments, one of which is maintained at a temperature above freezing for the storage of fresh foods and the other of which is maintained at a temperature below freezing for storage of frozen foods. An evaporator, which comprises a metal plate having a cooling element mounted thereon in heat exchange relationship is provided for effecting cooling of both compartments. The evaporator is positioned in the cabinet in such a manner that the cooling element is disposed in a first passage and air is circulated over the cooling element and thence in proportioned amounts to the aforementioned compartments. To reduce the amount of frost collecting on the cooling element a second passage is provided in the refrigerator cabinet adjacent the opposite side of the plate from that on which the cooling element is mounted. The plate separates the returning fresh food air from the air fed directly back to the cooling element from the frozen food compartment, and the coils of the cooling element are in heat conductive contact with this plate. This maintains the plate temperature close to the temperature of the cooling element. With this arrangement moist air returning from the fresh food compartment is caused to circulate through this second passage in contact with the aforementioned plate so that a substantial amount of the moisture in this air deposits on the plate as frost before the air reaches the first passage and the cooling element. Unless the plate is maintained at a temperature close to the temperature of the cooling element, as described above, the moisture condensed out on the plate would quickly migrate to the cooling element minimizing the advantages of pre-conditioning the returning fresh food air. The plate is spaced from the rear inner wall of the refrigerator by flanges formed at opposite edges of the plate to thereby form the second passage between the plate and the inner wall of the refrigerator. The warm air circulating through the second passage, which is disposed adjacent a substantial portion of the rear inner wall of the refrigerator, reduces heat leakage from the exterior of the refrigerator to the interior of the refrigerator.

DESCRIPTION OF THE DRAWINGS

The invention may be better understood by referring to the accompanying drawings in which.

DESCRIPTION OF THE PREFERRED EMBODIMENT

Figure 1:
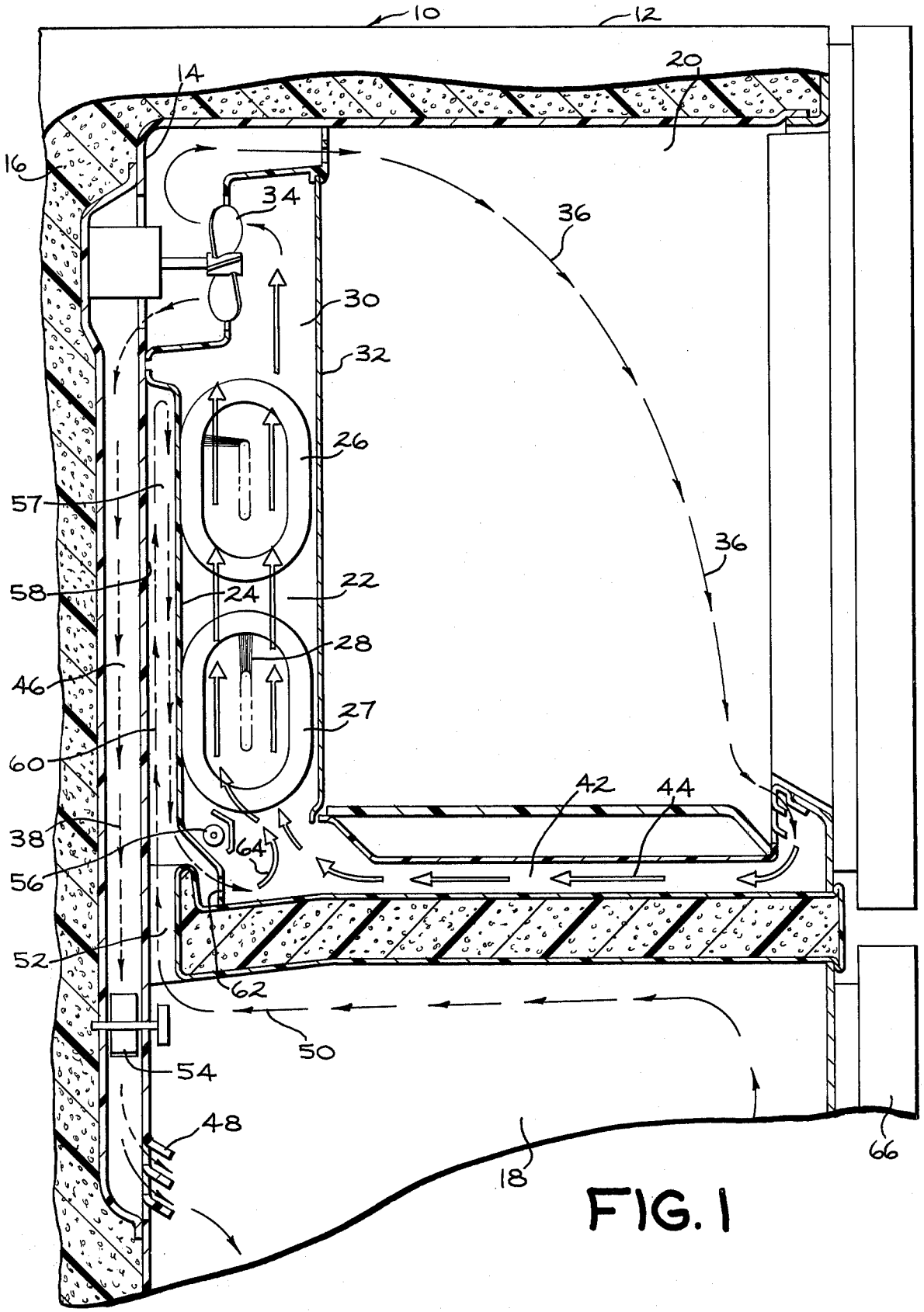
FIG. 1 is a sectional elevation view, partly broken away, of a portion of a refrigerator cabinet incorporating this invention.

Referring now to the drawings there is shown a refrigerator cabinet 10 which includes an outer wall 12 and an inner wall 14 spaced from the outer wall. The space between the outer and inner walls is filled with terminal insulation 16 in a conventional manner.

Formed within the interior of the refrigerator cabinet are a first compartment 18 positioned in the bottom portion of the cabinet and a second compartment 20 positioned in the top portion of the cabinet. The compartment 18 is to be maintained at a temperature above freezing for the storage of fresh foods and the compartment 20 is to be maintained at a temperature below freezing for the storage of frozen foods.

In order to provide cooling for both compartments an evaporator, designed generally by the numeral 22, is provided. The evaporator includes a flat metal plate 24 and a cooling element 26 mounted on the plate 24 in heat exchange relationship. The cooling element 26 may be of the type disclosed in U.S. Pat. No. 3,766,976 covering an invention of Robert B. Gelbard and Norbert P. Haag and assigned to the assignee of the present invention. In order to provide extensive cooling surface for optimum cooling of air flowing thereover the cooling element includes a plurality of coils of tubing 27 and a plurality of heat exchanger fins 28 extending inwardly from the tubing substantially to the center of the coils. The cooling element construction shown in the drawings and other structures of this type provide substantial surface for heat transfer to the cooling element from the air flowing thereover. However, a cooling element so constructed necessarily occupies a substantial portion of the cross-sectional area of a first vertical passage 30 in which the cooling element is positioned, thereby partially obstructing the passage 30. The passage 30 is formed primarily by a back wall 32 of the compartment 20 and the plate 24.

In order to provide cooling for both compartments 18 and 20 provision is made for circulating air over the cooling element, for circulating the cooled air to the two compartments in the desired proportion, and for returning the air from the compartments to the cooling element. In the form of the invention illustrated, this circulation of air is effected by a fan 34 positioned adjacent the top of the vertical passage 30. The fan causes the air flowing over the cooling element 26 to be directed in part to the upper compartment 20 as indicated by the arrows 36 and in part to the lower compartment 18, as indicated by the arrows 38. The lower compartment 18 is normally operated at an above-freezing temperature, for example, about 40° F., and the upper compartment 20 is normally operated at a temperature below-freezing, for example, about 5° F. The evaporator 22 which is employed for cooling both compartments is normally operated at a temperature of about −5° F. Since the upper compartment must be maintained at a much lower temperature, a much greater proportion of the coled air is directed to that compartment. For example, approximately 90% of the air may be directed to the compartment 20 and approximately 10% to the compartment 18. The cooled air is directed to the compartment 20 through a plurality of louvers 40 formed along the top of the back wall of the compartment 20 and is returned to the cooling element 26 through a passage 42 extending below the bottom wall of the compartment 20, this return flow of air being indicated by the arrows 44.

Cooled air is supplied to the compartment 18 by the fan 34 through a passage 46 formed at the back of the refrigerator. The passage 46 terminates at a plurality of louvers 48 formed in the back wall of the compartment 18. Air is returned to the cooling element from the compartment 18 through passages 52 disposed at the back of the refrigerator at each side thereof. In order to adjust the temperature of the below freezing compartment 20, a manually-controlled damper 54 is provided in the passage 46. By adjusting the position of the damper 54, the user can cause a greater or lesser amount of air to be directed to the compartment 20.

In the operation of refrigerators of this type, wherein the air for cooling the above-freezing and below-freezing compartments is cooled by causing it to flow over a cooling element located outside the compartments, frost is caused to deposit on the cooling element from the moisture in the air and particularly moisture in the air being returned from the above-freezing compartment 18. Such frost, as it accumulates, reduces the cooling efficiency of the evaporator and hence the efficiency of the refrigerator in two ways. The frost depositing on the tubing 27 of the cooling element 26 provides an insulating coating on the tubing which retards heat transfer to the cool refrigerant inside the tubing from the air flowing thereover. Secondly, since the evaporator, as mentioned earlier, occupies a substantial portion of the cross-sectional area of the passage 30, thereby partially obstructing the passage 30, the accumulation of frost on the tubing over a period of time materially reduces the remaining cross-sectonal area available for air flow and thereby further decreases the cooling provided by the evaporator and the cooling element thereof.

In order to maintain the refrigerator at a desirable level of operating efficiency, it is necessary from time to time to remove the frost from the evaporator. This may be accomplished in a number of ways, for example, by providing an electric heating element which is energized at intervals to melt the frost. A suitable electric heating element 56 for this purpose is shown in the drawings extending transversely of the passage 30 near the bottom thereof. It is impossible, of course, to cause all of the heat from the electic heating element to be confined totally to melting the frost on the evaporator. Perhaps as much as 75% of the heat in a conventional refrigerator may be directed to portions of the refrigerator other than the frost on the evaporator, thereby undesirably raising the temperatures of the frozen foods and fresh foods stored therein and reducing the efficiency of the refrigerator. It is, therefore, desirable that the length of time between defrosting operations be extended as long as reasonably possible and that the heating element be operated for as short a time as possible in accomplishing the defrosting operation.

Figure 2:
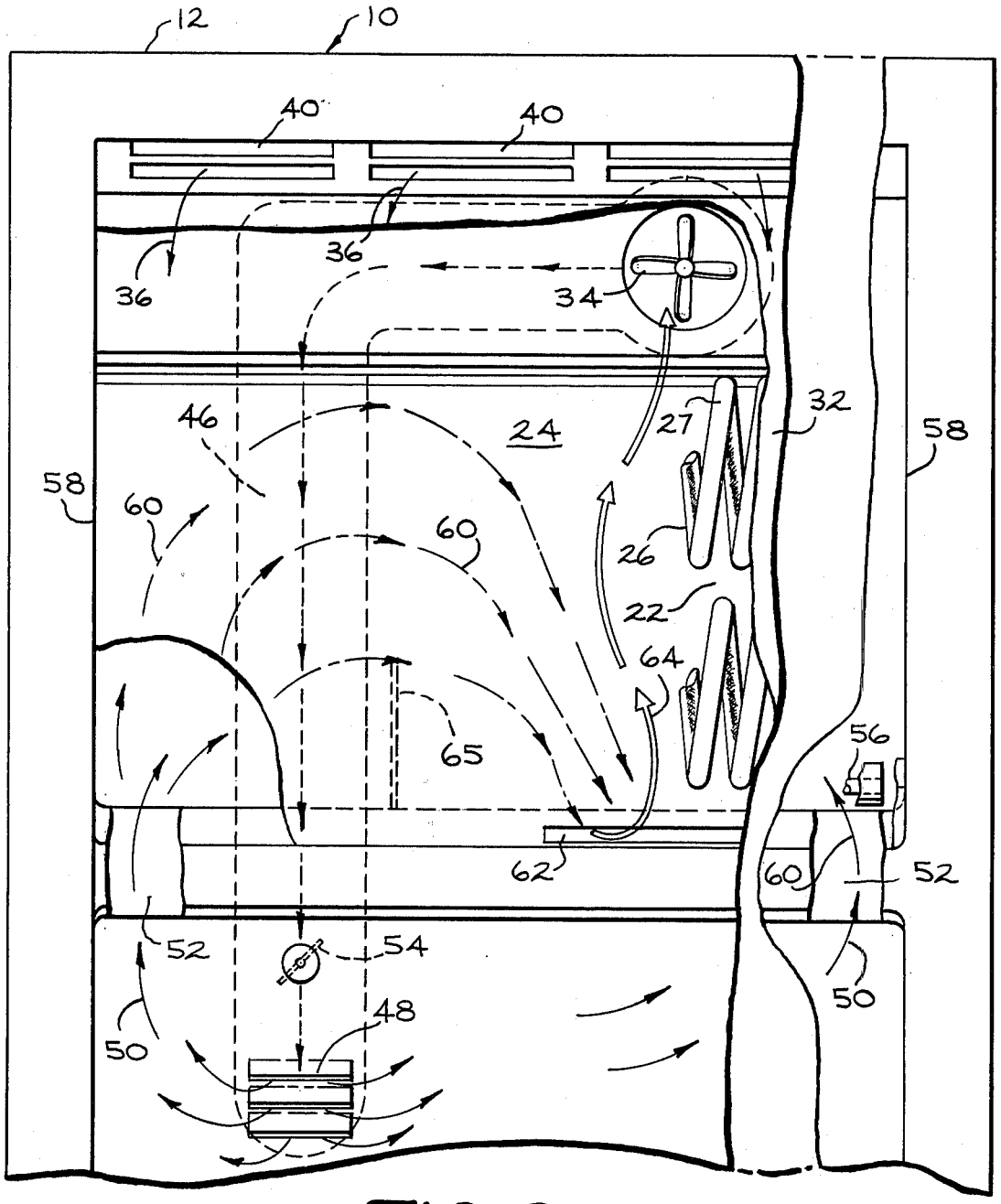
FIG. 2 is a front elevation view, also partly broken away, of the portion of the refrigerator shown in FIG. 1.

In accordance with the present invention these desirable objectives are achieved by reducing the amount of frost deposited on the cooling element 26 and causing it to preferentially deposit in an area where it will have lesser effect on the circulation of air and on the efficiency of operation of the refrigerator. For this purpose the refrigerator is constructed to provide a second vertical passage 57 formed adjacent the plate 54 and on the opposite side of the plate from that on which the cooling element 26 is mounted. Although the passage 57 may be formed in any manner between the plate 24 and the inner wall 14 of the refrigerator, it is conveniently and economically formed by providing, at the edges of the plate 24, flanges 58 which extend rearwardly into engagement with a portion of the inner wall 14. The passage 57, as can best be visualized from FIG. 2, extend across the substantially entire width of the rear wall of the refrigerator at the top portion of the refrigerator. Passages 52 through which air is returned from the compartment 18 are caused to direct the air first into the passage 57 before this air is allowed to come in contact with the cooling element 26. As shown by the arrows 60, this return air is caused by inertia to flow upwardly a substantial distance in vertical passage 57 and in contact with the plate 24 which forms part of the evaporator 22 and is essentially at the same low temperature, namely, approximately −5° F., as the cooling element 26. An opening 62 extending transversely at the bottom of the plate 24 is provided for directing air from the second passage 57 to the first passage 30 and thence over the cooling element 26, as shown by the arrows 64. Thus, the air returning from the above-freezing compartment 18 is caused to flow upwardly in the vertical passage 57 over a portion of the plate 24 of the evaporator 22 and thence downwardly over this plate 24 to the opening 62 from which it passes into the first passage 30 and thence over the cooling element 26. Even though the inertia of the air entering passage 57 may not be enough to carry the air in contact with the entire surface of the plate 24 frost will still tend to form over this entire surface because of frost migration to colder surfaces. If, for example, frost should initially form on the bottom portion of the plate 24, the insulating effect will tend to make the bottom area warmer than the upper unfrosted area of plate 24 and collected frost will, therefore, migrate to the upper colder area to produce a relatively even coating of frost on the plate 24.

If it is desired to insure air circulation in the passage 57 over the entire surface of the plate 24, vertical baffles, one of which is shown at 65, may be added to the passage 57 between the openings 52 and the opening 62. The baffles extend between the plate 24 and the inner wall 14 and extend a substantial distance upwardly in the passage 57, thereby causing the air returning from the compartment 18 to be directed across a greater area of the plate 24. Satisfactory operation can, however, be obtained without employing the baffles 65.

The above-freezing compartment 18 is used to store fresh foods and in normal usage there is much more frequent occasion for access to this compartment than to the compartment 20 which is maintained at a below-freezing temperature for storage of frozen foods. Particularly in warm humid weather, as the door 66 providing access to the compartment 18 is opened, air with substantial amount of moisture therein is admitted to the compartment 18. Such moisture, of course, has a tendency to deposit as frost when it strikes the evaporator. In accordance with this invention the moisture-laden air returning from the compartment 18 is caused to pass first through the passage 57 in contact with the cold surface of the plate 24 so that the frost preferentially deposits on this plate. As a result, the moisture content of the air passing through the opening 62 to the passage 30 has been substantially reduced before it comes in contact with the cooling element 26. Accordingly, the frost collecting on the cooling element 26 is very much reduced from the amount which would collect in the absence of the construction provided by this invention. Moreover, the passage 57, as illustrated in the drawings, is substantially unobstructed so that even a significant amount of frost collecting on the plate 24 in the passage 57 will not seriously impede the flow of air through this passage. By contrast, the same amount of frost collecting on the cooling element 26 would have a much more serious impeding effect on air flow because, as mentioned earlier, the passage 30 in which the cooling element 26 is arranged has a substantial portion of its cross-sectional area obstructed by the coils of tubing 27 which form the cooling element 26.

Moreover, as indicated earlier, only about 10% of the total air flow is directed to the compartment 18, the remaining 90% being directed to the compartment 20. The total amount of air being circulated flows over the cooling element 26, the return flows of air from the compartment 18 and the compartment 20 being combined at the bottom of passage 30. Since the amount of air flowing through passage 57 is only one-tenth that flowing through passage 30, the impeding effect of frost deposited in passage 57 on air flow therethrough is much less than the deposition of the same amount of frost in passage 30.

As a result of the arrangement of this invention two advantages are obtained and the manufacturer may chose to maximize one or the other. The defrosting operation may be performed much less frequently than with refrigerators not incorporating this invention since the frost may accumulate for a substantially longer period of time on the cooling element 26 before it reaches an amount which materially interferes with the efficiency of the refrigerator. Alternatively, the refrigerator may be programmed to defrost at the same intervals as in refrigerators not incorporating this invention. In that case, the frost which had accumulated and which would have to be removed from the cooling element would be of a lesser amount and the defrosting operation could be accomplished more quickly and with a lesser amount of heat and therefore with reduced transfer of heat to foods stored in the refrigerator.

The defrost heater will, therefore, either be operated less frequently or will be operated for a shorter period of time during each defrosting operation, thereby, in either event, effecting a reduction in power consumption.

The air circulating and cooling arrangement of this invention is provided very economically since it takes advantage of structures already employed in refrigerator cabinets with only a minimal addition thereto. Specifically, evaporators including coils of tubing, such as those shown in the evaporator disclosed in the drawings, are conventionally constructed by mounting the coils of tubing on a plate such as the plate 24. Accordingly, in carrying out this invention, it is merely necessary to add to this conventional structure flanges 58 approximately ¾ inches in width to form the passage 57. These flanges are formed on the plate 24 at the edges thereof and abut the rear inner wall of the refrigerator to form the aforementioned passage. Thus, only a minimal additional material is required to carry out this invention.

Moreover, the passage 57, as mentioned previously, extends over a substantial portion of the rear inner wall of the refrigerator and hence is interposed between the exterior and the interior of the refrigerator. Since the air flowing through this passage is warmer air returning from the compartment 18, this warm air, substantially filling the passage 57, reduces heat leakage from the warmer ambient air to the interior of the refrigerator.

While a specific embodiment of this invention has been shown and described, the invention is not limited to the particular structure shown and described, and it is intended by the appended claims to cover all modifications which come within the spirit and scope of this invention.

We claim:

1. In a refrigerator including a first food storage compartment to be maintained at a temperature above freezing and a second food storage compartment to be maintained at a temperature below freezing, an air circulating and cooling arrangement comprising:

(a) an evaporator including a plate and a cooling element mounted on one side of said plate in heat exchange relationship therewith;
(b) said cooling element being positioned in a first passage outside both of said compartments;
(c) means defining a second passage on the opposite side of said plate from said cooling element;
(d) means for circulating air over said evaporator and through said compartments; and
(e) means for directing air from said first compartment to said second passage and thereafter to said first passage, whereby moisture is removed from the air in said second passage before the air contacts said cooling element.

2. The air circulating and cooling arrangement of claim 1, wherein said second passage is disposed between said first passage and a wall of the refrigerator, whereby the warmer air returning from said first compartment retards heat leakage from the exterior of the refrigerator to the interior of the refrigerator.

3. In a refrigerator including a first food storage compartment to be maintained at a temperature above freezing and a second food storage compartment to be maintained at a temperature below freezing, an air circulating said cooling arrangement comprising:

(a) an evaporator including a plate and a cooling element mounted on one side of said plate in heat exchange relationship therewith;
(b) means including said plate defining a first passage outside both of said compartments, said cooling element being disposed in said first passage;
(c) means including said plate defining a second passage on the opposite side of said plate from said cooling element;
(d) means for circulating air over said evaporator and through said compartments; and
(e) means for directing air from said first compartment to said second passage and thereafter to said first passage, whereby moisture is removed from the air in said second passage before the air contacts said cooling element.

4. The air circulating and cooling arrangement of claim 3, and further including means disposed adjacent said cooling element and said plate for removing frost from said cooling element and said plate.

5. The air circulation and cooling arrangement of claim 4, wherein said means for removing frost includes a heating element extending transversely of said first passage near the bottom thereof.

6. In a refrigerator including a rear outer wall and a rear inner wall spaced from said outer wall and having thermal insulation between said outer wall and said inner wall, and further including a first food storage compartment to be maintained at a temperature above freezing and a second food storage compartment to be maintained at a temperature below freezing, an air circulating and cooling arrangement comprising:

(a) an evaporator including a plate and a cooling element mounted on one side of said plate in heat exchange relationship therewith;
(b) means including said plate defining a first passage outside both of said compartments, said cooling element being disposed in said first passage;
(c) means including said plate and a portion of said inner wall defining a second passage on the opposite side of said plate from said cooling element;
(d) means for circulating air over said evaporator and through said compartments; and
(e) means for directing air to said second passage warmer air returning from said first compartment and thereafter directing said air to said first passage, whereby moisture is removed from said air in said second passage before said air contacts said cooling element in said first passage;
(f) said second passage being disposed adjacent a substantial portion of said inner wall whereby said warmer air passing through said second passage adjacent said substantial portion of said inner wall causes a reduction in heat leakage from the exterior of the refrigerator to the interior of the refrigerator.

7. The air circulating and cooling arrangement of claim 6, and further including flanges formed on said plate and extending perpendicularly to said plate, said flanges engaging said inner wall for spacing said plate from said inner wall to provide said second passage.

8. The air circulating and cooling arrangement of claim 7, wherein said second passage is substantially defined by said opposite side of said plate and said inner wall so that said second passage is unobstructed and a significant accumulation of frost may occur therein without materially reducing air flow therethrough.

9. In a refrigerator including a rear outer wall and a rear inner wall spaced from said outer wall and having a thermal insulation between said outer and said inner wall, and further including a first food storage compartment to be maintained at a temperature above freezing and a second food storage compartment to be maintained at a temperature below freezing, an air circulating and cooling arrangement comprising:

(a) an evaporator including a plate and a cooling element mounted on one side of said plate in heat exchange relationship therewith;

(b) means including said plate defining a first vertical passage outside said compartments, said cooling element being disposed in said first passage, said cooling element occupying a substantial portion of the cross-sectional area of said first passage and partially obstructing said first passage;

(c) means including said plate and a portion of said inner wall defining a second vertical passage on the opposite side of said plate from said cooling element, said second passage providing substantially unobstructed flow of air therethrough; and (d) means for directing said air from said first compartment over said cooling element and back to said first compartment and for directing air from said second compartment over said cooling element and back to said second compartment;

(e) said last-named means including means for directing air from said first compartment through said second passage for removal of moisture therefrom before directing said air to said first passage, whereby frost is preferentially deposited in said second passage which is substantially unobstructed rather than in said second passage which is partially obstructed by said cooling element.

10. The air circulating and cooling arrangement of claim 9, and further including a heating element near the bottom of said first passage for effecting removal of frost from both passages.

11. The air circulating and cooling arrangement of claim 9, wherein said second passage is disposed against a substantial portion of said inner wall whereby warmer air from said first compartment passing through said second passage adjacent said substantial portion of said inner wall causes a reduction in heat leakage from the exterior of the refrigerator to the interior of the refrigerator.

12. The air circulating and cooling arrangement of claim 9, wherein said means for directing air from said first compartment includes a first opening in said first compartment at each side of the back wall thereof for directing air to said second passage and a second opening at the bottom of a central portion of said plate for directing air from said second passage to said first passage.

13. The air circulating and cooling arrangement of claim 12, and further including vertical baffles in said second passage, said baffles being disposed between said first openings and said second opening for causing air in said second passage to be directed over substantially the entire surface of said plate.

* * * * *